United States Patent [19]

Chan et al.

[11] 3,985,584

[45] Oct. 12, 1976

[54] METAL PROTECTIVE COATING COMPOSITIONS, THEIR PREPARATION AND USE

[75] Inventors: Francis Chee Keung Chan, Berkeley Heights; Edward Heinzelman, Jr., Palisades, both of N.J.

[73] Assignee: Oakite Products, Inc., Berkeley Heights, N.J.

[22] Filed: Oct. 25, 1972

[21] Appl. No.: 300,662

Related U.S. Application Data

[63] Continuation-in-part of Ser. No. 34,904, May 5, 1970, abandoned.

[52] U.S. Cl. ..... 148/6.16; 148/31.5

[51] Int. Cl.[2] ..... C23C 11/00

[58] Field of Search ..... 148/6.16, 31.5

[56] References Cited

UNITED STATES PATENTS

| | | | |
|---|---|---|---|
| 2,737,498 | 3/1956 | Frasch | 148/6.16 |
| 3,175,964 | 3/1965 | Watanabe et al. | 148/6.16 |
| 3,189,489 | 6/1965 | Schiffman | 148/6.16 |

OTHER PUBLICATIONS

Schildknecht, Vinyl and Related Polymers, Wiley & Sons, (1956), p. 345.

*Primary Examiner*—John D. Welsh

[57] ABSTRACT

Disclosed is an acid, aqueous metal surface treating composition comprising chromium phosphate, chromic acid, a phosphate ion providing compound and a polyvinyl alcohol polymer hydrolyzed to at least 99%. Also present is a phosphate of a water soluble amine.

15 Claims, No Drawings

METAL PROTECTIVE COATING COMPOSITIONS, THEIR PREPARATION AND USE

This is a continuation-in-part of copending application Ser. No. 34,904 filed May 5, 1970 now abandoned.

This invention is that of aqueous acid compositions containing certain essential co-acting ingredients and effective to provide water-insoluble combined deposition and reaction coatings on metals such as zinc, galvanized steel, aluminum, copper, tin, cadmium, titanium, and steel, and suitable to enhance their corrosion resistance and also to serve as an enhanced adhesion precoat for a subsequent organic finish coating such as a resin, lacquer or paint finish.

More particularly the aqueous acid compositions of the invention contain as (a) acid-providing ingredients (i) an acid phosphate-ion-containing compound such as phosphoric acid and/or an alkali metal or ammonium dihydrogen phosphate, and (ii) chromic acid; and (b) chromium phosphate (the $CrO_3$ equivalent of which jointly with the chromic acid generally being present in lesser amount than the phosphoric acid and/or any acid phosphate), (c) in lesser amount than the chromic acid and its phosphate an at least 99% hydrolyzed polyvinyl alcohol (hereinafter called merely PVA) combined with chromium and phosphate, and (d) as a curing agent for, and in a lesser amount than the PVA, a non-aromatic primary, secondary or tertiary aliphatic amine, alkanolamine, morpholine or alkyl-substituted morpholine, as defined below.

These coating compositions include the foregoing (A) in one form as a concentrate containing a total, say, of from about 60 to about 85 percent of the essential co-acting ingredients dissolved in water, and (B) as for many of their applications as dilute treating baths containing by volume from about 0.5 percent to about 5 percent, and when the applied coating is to be the final coat, then from about 10 or about 20 percent and even much more, of the concentrated composition with the balance water.

The invention includes also the method of producing the acid aqueous concentrate of the invention as well as the protective deposition and complex reaction coatings on surfaces of the metals to be treated, and also zinc, galvanized steel, aluminum, copper, cadmium, titanium, or steel metal objects coated with a water-insoluble and methanol-insoluble film provided by the aqueous acid coating compositions of the invention.

Serious problems have been encountered with the various aforementioned metals, for example, the development during storage of corrosion on steel, staining (such as by oxidation) on copper, cadmium, and aluminum, tarnishing (such as a brownish oxidation stain) on tin, oxidation on titanium, and of white rust on zinc and galvanized steel. Prior methods used to protect these metals against such staining, tarnishing, and corrosion before final use are unreliable and inadequate, and often present difficulty in the application of a subsequent processing such as a conversion coating or prepaint treatment.

These various shortcomings and disadvantages are avoided by the various parts of the invention which provide a relatively low cost protective coating, for example, against the development of white rust on zinc or on galvanized steel, staining on copper, cadmium or aluminum, tarnishing on tin, oxidation on titanium, and corrosion on steel, which does not mar the metal surface, and is easily and inexpensively removed if necessary. Additionally, the protective coatings provided by the compositions of the invention, beneficially from a higher concentration of treating bath, serve as a final finish or a prepaint coating similar to a base or primer precoat for a metal surface that is to be painted for final use.

Thus, these latter mentioned protective coatings resulting from application of the coating compositions of the invention provide a surface that manifests enhanced adhesion as an undercoat for the various types of paints such as those of acrylic, vinyl, epoxy, or alkyd resin-based and other paints. Such protective coatings thus serve to enhance the adhesion of these various paints to the surfaces of the thus treated various metals such as zinc, galvanized steel as in hot dip galvanized coil steel, aluminum, copper, cadmium, titanium, and tin.

A further feature of the compositions of the invention is that the protective coating is not adversely affected by exposure to agents such as the usual mild alkaline cleaners employed to remove soil stains and handling marks from such metal surfaces preliminary to painting them.

The generally predominant essential constituent for the protective coating compositions of the invention is the water-soluble, acid phosphate-ion-providing compound, used in the concentrate in an amount equivalent to from about 12 to about 50 percent by weight of the commercial phosphoric acid (80%, i. e. containing that percentage of the anhydrous acid), or in the range of from about 9.6% to about 40% calculated as anhydrous phosphoric acid ($H_3PO_4$). Suitable such phosphate-ion-providing compounds are phosphoric acid itself (such as its commonly commercially available 80% $H_3PO_4$ strength), any of the alkali metal dihydrogen phosphates such as sodium dihydrogen phosphate, potassium dihydrogen phosphate, lithium dihydrogen phosphate, and also ammonium dihydrogen phosphate, as well as mixtures of any of them.

The next predominant ingredient of these coating compositions is the chromic acid, generally used in its commercially available anhydrous flake form as $CrO_3$, and in the concentrate in the range of from about 5% to about 30% by weight. The ratio of the phosphate-ion-providing compound to the chromic acid is from about 1 to about 2.5 parts calculated as equivalent phosphoric acid (80% strength in the commercially available concentrated acid), to from about 0.5 to about 1 part of chromic acid (calculated as $CrO_3$).

The third essential constituent of the protective coating compositions of the invention is the PVA which can be included in the concentrate broadly to the extent of from about 0.1% to about 10% by weight or in an optimal range of from about 1.0 to about 3%. The PVA should be the so-called fully hydrolyzed product which grade generally is 99.7+% hydrolyzed, that is to say, contains generally less than 0.3% of residual polyvinyl acetate. The PVA advantageously should be medium viscosity grade with a degree of polymerization of 1750 and average molecular weight of about 78,200, which in a 4% aqueous solution shows at room temperature (i.e. 20° C.) a Brookfield viscosity of 28 to 32 centipoises. Also suitable is the similarly fully hydrolyzed PVA whose degree of polymerization is 2300 with average molecular weight of about 101,200 and Brookfield viscosity of 55 to 65 centipoises.

In some instances a PVA which is at least 99.0% hydrolyzed (i.e. contains no more than 1% residual acetate groups) can be used. However, for generally optimal results it is better that the PVA be at least about 99.5% hydrolyzed (containing no more than about 0.5% residual acetate groups).

In general, the concentrate within the bounds of practical operation can contain by weight as little as about 0.1% of the PVA resin up to about 10% of it, although the more effective optimum range is from about 1.0 to about 3.0% of it in the concentrate.

For the protective coating compositions of the invention to dry to an effectively adherent and non-tacky film, they include as the fourth essential ingredient a curing agent for the PVA, which is a water-soluble (to at least about 0.05%), non-aromatic primary, secondary, or tertiary amine having a total of from 1 to about 12 carbon atoms and being straight or branched chain alkylamine, or hydroxyl-substituted as an alkanolamine, or cycloalkylamine or morpholine, each of which latter two can be mono- or di-(lower)alkyl (e.g. methyl or ethyl) substituted on the ring or on the nitrogen.

Such amine curing agent for PVA then includes, for example, (a) the primary alkylamines such as ethyl amine, propyl amine, isopropyl amine, butyl amine, hexyl amine, cyclohexylamine, 2-ethylhexyl amine, and (b) secondary alkylamines such as diethylamine, dipropylamine, diisopropylamine, dibutylamine, cyclohexylamine, N-methyl butylamine, N-ethyl butylamine, N-ethyl cyclohexylamine, and (c) tertiary amines such as triethylamine, tributylamine, (d) primary alkanolamines exemplified by monoethanolamine, monoisopropanolamine, and polyglycolamine, (e) the secondary alkanolamines as diethanolamine, N-methyl ethanolamine, N-aminoethyl ethanolamine, and diisopropanolamine; (f) tertiary alkanolamines as triethanolamine, N,N-dimethyl ethanolamine, N,N-diethyl ethanolamine, N,N-diisopropyl ethanolamine, N-methyl diethanolamine, and triisopropanolamine; and (g) heterocyclic secondary amines such as morpholine, ring-substituted morpholine as 2,6-dimethyl morpholine, N-substituted morpholine as N-methyl morpholine, N-ethyl morpholine, and N-(3-amino propyl) morpholine.

Mixtures of any of these foregoing various amines may be used. A commercially available mixture is the mixed isopropanolamines available in various mixtures such as 10–15% mono-, 40–50% di- and 40–50% triisopropanolamine. The concentrate can contain by weight from 0.1 to about 1% of the amine curing agent which may be any one or more of the foregoing identified applicable amines.

The concentrate, and also the diluted treating baths prepared from it, are effective for the indicated uses with each of the foregoing four essential ingredients dissolved in water, each of them within its above disclosed respective range of concentration.

However, the flowability of the aqueous acid coating compositions and uniformity of the resulting applied films are enhanced by incorporating in the concentrate a wetting agent compatible with its active agents and in a concentration of from about 0.1% to about 1% by weight. Alternatively, the wetting agent may be added to the diluted working solution. As presently indicated, the anionic or nonionic wetting agents are more desirable over the cationic which also can be used.

Illustrative of the anionic wetting agents is the 'Triton H66' potassium salt of a phosphate ester available in aqueous solution containing 50% of the anionic ester (product of Rohm & Haas, Philadelphia, Pa.), dioctyl sodium sulfosuccinate, the perfluoroalkyl sulfonic acids having 8 carbon atoms (with alkyl being generic to open chain alkyl as well as dimethyl and ethyl-substituted cyclohexyl) such as perfluoro normal-octyl sulfonic acid, perfluoro 2,5-dimethylcyclohexyl sulfonic acid, and perfluoro 4-ethylcyclohexyl sulfonic acid, and also the alkali metal long chain alkyl sulfates as sodium lauryl sulfate, mixed sodium lauryl and oleyl sulfates, or sodium mixed long chain (e.g. lauryl and oleyl) sulfates.

Illustrative applicable nonionic wetting agents are the 'Triton X-100' octyl phenoxy polyethoxy ethanol, 'Triton DF-12' modified polyethoxylated straight chain alcohol, both of these 'Triton' products also being of Rohm & Haas, and 'Tergitol MinFoam 2X' modified linear alcohol ethoxylate, of Union Carbide Corp.

The cationic wetting agents are illustrated by benzethonium chloride, and cetyl pyridium bromide.

The concentrates of any of the herein described formulations are dark green, non-hydroscopic, and infinitely soluble in water. The various dilutions of the concentrate to provide the wide range of treating baths vary in color from dark to light green. Both the concentrates and all of the diluted treating baths made from them are highly fluid and easily metered by automatic metering equipment, manifest excellent corrosion-inhibiting properties in the common storing and handling equipment and are easily and quickly rinsed away.

For application as a (final) finished coat on any of the various metals, the treating bath compositions are prepared by diluting the selected concentrate with water, taking the concentrate (by volume) at from as little as 0.5% by volume to somewhere about 10% or up to about 20% and increasingly higher even up to full strength.

Any of the foregoing different types of treatments available with the indicated various dilutions or full strength of concentrate is carried out better at a temperature of at least about 80°F. and usually beneficially at from about 90° to about 125° F. It is unnecessary to rinse the treated metals for ordinarily the excess composition runs off readily and the treated product usually is promptly dried, e.g. air dried or put through a drier, and in the case of treated plate, sheet or continuous strip, the metal can be run through squeegee rollers and from thereon into the drier.

The treatment, particularly with the baths made from under 5% of concentrate (by volume), generally does not alter the appearance of the treated metal, especially so as to the characteristic spangled appearance of the galvanized steel. Treatment of the light color metals such as aluminum, tin, cadmium, titanium, zinc and steel generally show no noticeable change in color except after treatment with the bath containing a higher percentage of the concentrate, such as over 5% (by volume) and up to full concentration, when a from very light to light green appearance may be seen. Thus, the treating baths from over 5% of concentrate (by volume) can be used to prepare slightly colored coatings.

The resulting combination deposition and conversion coating produced by the treating compositions of the invention are water insoluble and indicate the presence in them of phosphate possibly in ester combination from the phosphoric acid with hydroxyl groups of the resin, and chromium possibly in some way combined with the resin structure and in a measure present as chromium phosphate.

Where the coating is one other than a precoat or primer to be subsequently painted over or is to remain as the finished coat, and the protected metal is to be subjected to some other final treatment such as any of the various phosphatizing treatments, after taking the protected product from storage, the coating can be removed with the stronger alkaline cleaners containing sequestering agets such as the tri- or tetra-sodium ethylenediamine tetraacetic acid, tri to penta-sodium ethylenetriamine pentaacetic acid, the sodium salt of gluconic or heptogluconic acid, and the like, or together with sodium silicate, or with a strong phosphoric acid type of metal surface cleaner.

Considered broadly, the compositions of the invention comprise (A) the aqueous acid concentrate containing on a weight basis a total of from about 60 to about 85% of essential co-acting ingredients dispersed in from about 40 to about 15% of water, which essential co-acting ingredients (a) include chromium phosphate, phosphoric acid (or equivalent alkali metal or ammonium acid phosphate), the at least 99% hydrolyzed polyvinyl alcohol, and a phosphate of a water-soluble, non-aromatic primary, secondary or tertiary amine having from one to about 12 carbon atoms and selected from alkyl amines, alkanol amines, morpholine and ring- or N-substituted morpholine, or mixtures of any of these amines, and (b) are provided by heating together in the water (advantageously while maintaining the temperature at from about 170° to about 210° F., although it can be done even at boiling) (i) as the generally predominant essential constituent from about 9.6 to about 40 percent of phosphoric acid (on the anhydrous $H_3PO_4$ basis) or its phosphate-ion-equivalent of an alkali metal or ammonium dihydrogen phosphate, (ii) as the next predominant constituent from about 5% to about 30% of chromic acid (as $CrO_3$), (iii) the aforesaid polyvinyl alcohol as the third essential constituent to the extent of from about 0.1 to about 10%, and (iv) as the fourth essential ingredient the aforesaid water-soluble, non-aromatic primary, secondary or tertiary amine as a curing agent for the polyvinyl alcohol and to the extent of from about 0.1 to about 1 percent of the concentrate; and (B) treating baths composed of from about 0.5 part to about 99.5 parts by volume of any of the concentrates diluted with from about 99.5 parts to about 0.5 part of water by volume.

In the foregoing constitution of the concentrates the percentages in the respective ranges of the four essential ingredients are by weight of the concentrate. The aqueous treating baths embracing baths containing from 0.5 to about 3% of concentrate by volume serve, for example, for what may be temporary corrosion resistant coatings to protect metals being stored, for example, against white rust on zinc or galvanized steel or against corrosion on the other above-mentioned metals, until to be taken out to be given a different surface treatment. Treating baths containing over 2 and to about 4% of concentrate by volume serve for the same purpose in the treating tanks through which are passed high speed (e.g. 200 or more feet per minute) strip lines.

Treating baths containing from about 3 to about 5% or so of concentrate by volume are used to provide a precoat or base or primer coat to be painted over with a finished paint coating. The treating baths containing from about 10 to about 20% of concentrate by volume and higher even up to full strength are used to apply a combined deposition and reaction coating of the invention, which is to serve as a final or finish coat.

The chromium phosphate in the concentrate results from part of the starting phosphoric acid (or equivalent alkali metal or ammonium dihydrogen phosphate) and the chromic acid. The phosphate of the water-soluble amine comes from a small part of the phosphoric acid (or equivalent acid phosphate) and the water-soluble, non-aromatic amines. The phosphoric acid (or equivalent acid phosphate) in the concentrate is the remainder of the starting amount of that acid (or acid phosphate) which is not combined with the chromic acid and the amine.

Broadly considered, the concentrates of the invention are prepared by admixing the phosphate-ion-providing constituent (the phosphoric acid or alkali metal or ammonium dihydrogen phosphate) with the required amount of water to be present in the range of from about 9.6% to about 40% (calculated as anhydrous phosphoric acid), and also dissolving it in the chromic acid to provide it at from about 5% to about 30% and in the weight ratio of from about 0.5 to about 1 part of chromic acid (calculated as $CrO_3$) to from about 1 to about 2.5 parts of the phosphate-ion-providing constituent (calculated as equivalent commercial 80% phosphoric acid), heating the resulting diluted solution of phosphoric acid and chromic acid to a temperature sufficient to induce reaction with the at least 99% hydrolyzed PVA dissolved in the water, then with agitation admixing into that dilute solution of these acids an amount of an aqueous dispersion (slurry, suspension, or solution) of said PVA below that at which uncontrolled (or explosive) expansion of the reaction mixture could result from the exothermic reaction, and while still agitating and maintaining the reaction batch at from about 170° to 210° F. continuing adding the PVA dispersion at a rate sufficient to avoid such explosive expansion until there has reacted with the acid solution sufficient such PVA to provide it in the range of from about 0.1% to 10% of the concentrate; and before, with or after addition of said PVA, or even after admixing the phosphoric acid with water, adding a PVA-curing-effective amount (such as from about 0.1 to about 1% by weight of the concentrate) of a water-soluble non-aromatic amine curing agent (as earlier above described) for said at least 99% hydrolyzed PVA.

All percentages and parts in preparing the concentrate are by weight. The phosphoric acid and the chromic acid can be admixed simultaneously into the water, although it is preferable to dilute the phosphoric acid first and then to admix the chromic acid. The final mixture of the phosphoric acid into the water causes only a slight increase in temperature, for example, to about 74° F. or somewhat less when the water is cooler in the winter months.

Broadly considered, the method of producing the combined protective deposition and reaction coating on the earlier above identified metals comprises wetting the surface of said metal or applying to it a coating of an aqueous acid treating bath of this invention, and then drying the wet coating, for example, by air drying or at elevated temperature at least sufficient to evaporate the water from the coating and thus dry it, or also up to 300° or 400° F. or even as high as 500° depending on the rate of passage or dwell time of the metal sheet or objects in the drier.

The coated metals of the invention broadly comprise zinc, galvanized steel, aluminum, copper, cadmium, titanium, tin or steel coated with an integrally adhering water-insoluble combined deposition and reaction coating of a film of an (as above described) amine-cured at least 99% hydrolyzed polyvinyl alcohol combined with chromium and phosphate.

The pH of the concentrates and treating baths varies from about pH 0.35 for the undiluted concentrate to about pH 2 at a dilution of about one-half percent of the concentrate by volume, with a pH of 1.5 with the concentrate at 3% by volume, and a pH of 1.3 with the concentrate taken at 5% by volume.

If any of the metals or metal articles to be treated shows any stain or soil, they may be prepared for treatment by any of the usual cleaners for cleaning the surfaces of these metals for other treatment, for example, solvent for any oil or grease, and the common alkaline cleaners for other soil, followed by an adequate water rinse.

In addition to applying any of the treating baths or concentrates by wetting as by immersion, brush, roller, or flowcoating, any of the metals may be wetted by shower spray or jet stream, and the roller application may be either direct or reverse roller coating. The exposure of these metals or metal articles to any of the treating baths hereof may be for treatment from as little as one-half second, for example, with continuous strip passing through a bath containing 3% of concentrate by volume and maintained at the upper portion of the applicable temperature range of about 90° to 125° F. to about 3 seconds or to even 10 seconds or more at lower concentrations and/or temperatures.

The optimal immersion time for any specific metal or metal object in any particular concentration of treating bath readily can be established by a restricted number of tests with test pieces. After removal of any of the metal sheets or articles from exposure to the treating bath, without rinsing as stated, it can be dried at from about 200° to 250° F. or higher or even be hot air dried.

The protective coating composition concentrates of the invention are illustrated by, but not limited to, the following examples, wherein all parts are by weight:

EXAMPLE 1

320 parts of water and 450 parts of phosphoric acid (commercial 80% $H_3PO_4$ content) were charged into a reaction kettle (equipped for heating, cooling and agitation) and stirred until uniformly mixed. Stirring was continued throughout the rest of the procedure. Five parts of dipropylamine were added, and heating of the reaction solution was started and continued to raise its temperature above 100° F. Then 200 parts of chromic acid were added and the heating continued to raise the reaction solution to about 175° F.

Separately 20 parts of 99.7% hydrolyzed PVA were gradually sprinkled into 60 parts of tepid water while stirring to prepare a uniform slurry which, after all the chromic acid was dissolved (more than 15 minutes after its addition), was admixed into the agitated reaction solution while maintaining its temperature between 170° and 180° F., with recirculation of the reaction mixture and for the balance of the preparation.

From the addition of the PVA the temperature rose to about 190° F. The recirculation and agitation was continued for an hour while maintaining the temperature between 180° and 205° F. If then the specific gravity of the reaction solution at 68° F. is 1.44 plus or minus 0.005, the batch is considered finished. Otherwise, the mixing is continued and the temperature maintained above 180° and not exceeding 210° F. to drive off excess water and bring the specific gravity up to the just indicated test range.

To enhance the spreading of the bath solution used in coating the metals and also the overall uniformity of the resulting coating, a modification of this example includes, after the mixing was continued for an hour after adding the PVA, allowing the temperature to drop to about 180° F. when while still stirring there were admixed 5 pounds of the anionic wetting agent 'Triton H66' (containing 50% of the potassium salt of the organic phosphate ester) and the mixing continued for an hour while maintaining the temperature from 180° to 205° F. If then the specific gravity of the reaction solution at 68° F. is 1.44 plus or minus 0.005, the batch is considered finished. Otherwise, the mixing is continued and the temperature maintained above 180° and not exceeding 210° F. to drive off excess water and bring the specific gravity up to the just indicated test range.

EXAMPLE 2

By repeating the procedural steps of Example 1, the corresponding concentrate was obtained with enhanced tank life of its treating baths under use at high temperature, by replacing the Example 1 weights of ingredients by admixing 405 parts of water with 340 parts of the phosphoric acid (80% $H_3PO_4$), then admixing 30 parts of dipropylamine followed by 234 parts of chromic acid, and at least 15 minutes after admixture of the latter admixing a slurry of 15 parts of the PVA (99.7% hydrolyzed) in 45 parts of water; and continuing the heating within the range of 180° to 205° F. if needed to adjust to the specified final specific gravity.

Just as in preparing the modification of Example 1 by addition of the wetting agent, a corresponding modification of the concentrate of Example 2 was produced by admixing in it 30 parts of the anionic wetting agent 'Triton H66'.

EXAMPLE 3

By repeating both parts of Example 2 in all of its respects except for reducing the phosphoric acid to 300 parts in each case gave a concentrate, the diluted treating baths from which showed still further extended tank life than that of the treating baths prepared from the concentrates of both parts of Example 2.

In any of both parts of any of Examples 1 to 3, the phosphoric acid can be replaced in part or as a whole by a water-soluble alkali cation, namely, alkali metal or ammonium, dihydrogen phosphate, among which the alkali metal sodium or potassium dihydrogen phosphates are preferred, as long as the pH of the ultimate selected treating bath is from about 1.2 to about 3. In Examples 1 to 3 and the just described possible modifications of them, the dipropylamine can be replaced in part or as a whole by any other of the applicable water-soluble, non-aromatic amines described and exemplified earlier above.

Then too, in any of the foregoing examples or any of the herein described modifications of any of them, the PVA can be replaced in part or as a whole by any other PVA which is substantially fully hydrolyzed to the extent of at least 99%. In any of Examples 1 to 3 and any of the described modifications of any of them the slurry or suspension of the PVA can be replaced by the required volume, to provide the corresponding PVA content, of a separately prepared aqueous solution of it, for example, by agitating a slurry of 1 part of the at least 99% hydrolyzed PVA in 9 parts of water and heating it at about 200° F. until solution is complete (the parts being by weight).

Such aqueous PVA solution can be introduced at a determined constant rate to avoid uncontrolled (explosive) expansion of the reaction mixture. In the preparation of a concentrate, the agitation is continued after completing the addition of the PVA until the reaction is substantially completed. That is noted by the subsiding of the bubbling caused by the exothermic reaction between the acid and the added PVA.

Then also, in any of the foregoing examples and any of the described possible modifications of any of them, the specific anionic wetting agent can be replaced in part or as a whole by any other anionic or nonionic wetting agent of the type described and exemplified earlier above or by a cationic wetting agent although an anionic or nonionic wetting agent is more desirable.

Each of the just earlier described various possible modifications, in order to avoid making this disclosure prolix, is to be considered as if entirely occurring herein as if written out in full.

All of the phosphoric acid, the chromic acid, the at least 99% hydrolyzed PVA, and the water-soluble nonaromatic amine curing agent for this PVA are essential for the concentrate. When the chromic acid is omitted, the dry residue from the preparation is water-soluble. Omitting the phosphoric acid, the resulting dry residue is methanol soluble. On omitting the amine curing agent, the dry residue also is unsatisfactory by its being readily penetrable to water.

The at least 99% hydrolyzed PVA as of Example 1 was replaced by the same concentration of 98 to 98.8% hydrolyzed PVA, and two separate sets of 10 panels of galvanized steel each were coated, the first one with a treating bath from the Example 1 concentrate and the second one with such a bath from the concentrate from using the 98 to 98.8% hydrolyzed PVA. Each set was allowed to age for 24 hours. Then a separate stack was made of each set and weighted down with a 500 gram weight. Each stack was sprayed with deionized water every 24 hours. At the end of 7 days, the panels of the first set stack (treating bath from the Example 1 concentrate) showed no significant average white rust corrosion, but the second set stack showed average white rust corrosion over 1 to 5% of the panels surface area. After 17 days the first stack panels showed such corrosion on from none to only 2% of the panels surface area, whereas those of the second stack showed such corrosion over from 20 to 30% of the panels surface area.

The treating baths embraced by the invention are prepared by diluting any of the foregoing concentrates with various amounts of water depending on whether the treating bath is to be used (i) to apply merely a protective coating on the exposed surface of the particular one of the earlier above mentioned metals, for example, to treat zinc or galvanized steel strip, plate or articles of zinc or galvanized steel to prevent white rust, or (ii) to give any of the metals a precoat or base on a primer coating thereafter to be painted over; and (iii) also depending on whether the treatment is to be immersion of individual metal plate or articles in a steel tank or whether continuous strip or the like is to be run through the treating bath.

Thus, for example, if the treatment is to be applied to suspended metal sheets or plate or parts immersed in the bath or to large surfaces such as a storage tank wall or surfaces of equipment or vehicles (which application can be by roll-on, brush, or flow coat), the dilution by volume with water can be in the range of from 0.5% to 1 or even 3% of the concentrate. In the treatment of the metal fed from a roll or coil such as a high speed strip line, the dilution can be from about 2.0% to about 4% of the concentrate to compensate for the shorter dwell time (of contact) in the treating bath. However, if the treatment is to apply a precoat or primer or base coat later to be covered by painting, then the dilution with water can be by volume in the range of from about 3% to about 5% of the concentrate.

In the various applications of the dilute treating baths, the content of phosphoric acid or equivalent acid phosphate can vary from about 2 to about 35 grams of $H_3PO_4$ equivalent per liter of bath solution. Similarly, the chromic acid (as $CrO_3$) can vary from about 1 to about 18 grams per liter of bath solution. The PVA likewise can vary from 0.01 gram to about 7.5 grams per liter of the bath solution.

The method of treating metals with a coating bath of the invention is illustrated by, but not limited to, the following examples:

EXAMPLE 4

Hot dip zinc galvanized strip steel, after leaving the galvanizing tank and passed through the usual water rinse, was fed at a speed of 200 feet per minute through feeding rolls into an aqueous acid treating bath containing 3% by volume of the wetting agent-containing concentrate of Example 2. The thus treated zinc galvanized strip steel leaving the treating bath, after merely a few seconds exposure to it in the tank, was passed through squeegee rolls and continued on through a drying tunnel whose atmosphere was maintained at 250° F., from which the dried treated galvanized strip was rolled into a coil. The resulting finished coil thus was protected against development of white rust during storage.

EXAMPLE 5

Likewise, strip steel, and separately similarly strip aluminum, after passing through the cleaning and then rinsing tanks following the rolling operations on them is run by feeding rolls at a speed of 200 feet per minute into an aqueous acid treating bath containing by volume 5% of the wetting agent-containing concentrate of Example 2. After leaving the treating tank and passing through squeegee rolls and on through a similar drying tunnel maintained at 250° F., each of these steel and aluminum strips separately is rolled up into a coil. Each of them as thus treated is protected against staining in handling and corrosion, and then is ready after fabrication, or (as in the case of aluminum) being mounted as aluminum siding, to receive a final paint coat.

EXAMPLE 6

Sheet or plate copper or aluminum at different times separately is suspended and immersed for 5 seconds in a treating tank containing an aqueous acid treating bath prepared by diluting (by volume) with water 5% of the wetting agent-containing baths of Example 1, and then passed through a drying tunnel maintained at 250° F. The dried thus treated copper and aluminum sheets then are stored protected against handling stain and oxidation and ready as needed to receive a final coat of any of the commonly used paints.

EXAMPLE 7

Each of zinc sheet or plate and galvanized steel sheet or plate at different times is separately treated as in Example 6 and is ready for storage protected against white rust and thus ready for use at any time to receive a final paint coat with any of the earlier indicated paints.

EXAMPLE 8

Each of zinc and galvanized steel plate or sheet after initial weak alkaline cleaning if needed and in that case followed by a cold water rinse, is immersed for 5 seconds in an aqueous acid treating bath containing by volume 1.5% of the concentrate of Example 1, and then finished as in Example 6. After drying each of them is protected against white rust during storing and warehousing.

EXAMPLE 9

Each of titanium strip and wire at separate times, after a preliminary alkaline cleaning and water rinse if needed, is fed at a speed of 200 feet per minute through feeding rolls into an aqueous acid treating bath containing 3% by volume of the wetting agent-containing concentrate of Example 2. The thus treated titanium sheet and wire respectively leaving the treating bath after merely 3 to 5 seconds exposure to it in the tank, is passed through squeegee rolls and on through a drying tunnel with atmosphere maintained at 250° F. The dried treated titanium strip is rolled into a coil, and the treated titanium wire is collected on a roll, and thus more fully protected against oxidation during storage.

EXAMPLE 10

Cadmium plated steel strip and wire, after an acid cleaning and rinse if needed, are treated separately in the same way as the titanium strip and wire as in Example 9, and thereby similary protected against oxidation during storage. Cadmium parts or other objects or articles are treated similarly by being suspended from hooks or held in foraminated baskets (resistant to the bath) by submergence in the bath for the same time and then dried.

The respective baths used in any of the foregoing Examples 4 through 10 can be replaced by a treating bath having the corresponding concentration of any of the other above-described and exemplified concentrates, or by a different concentration of any of them within the range of concentrations respectively disclosed for use in the particular treatment, i.e. merely protective coat, final finish, or precoat or base or primer coat.

A finish paint coat can be applied to such precoat or primer coat at any time after it is dried, even before or without placing it in storage. Thus, any of the dried plate or sheet or even continuous strip with a precoat or primer coat can have a finish paint coat applied to it directly after it has been dried. For example, the continuous strip after leaving the drier can have such finish paint coat applied by roller coater while it still is a running strip. The primer coated plate or sheet likewise, for example, can be finish paint coated by spray painting.

The combination deposition and conversion coatings resulting from use of the treating baths of the invention are provided merely by the wetting with the treating bath followed by drying the treated metal surfaces.

Any such coating which is to be removed from cadmium or titanium can be removed by immersing the so coated metal surface for a sufficient time in a cleaner bath composed of 20 parts by volume (admixed with 80 parts by volume of water) of 70 parts by weight of the commercial 80% phosphoric acid admixed with 30 parts (by weight) of water plus 1% of a nonionic wetting agent, and heated at between 140° to 160° F.

The expression "lower alkyl" used in connection with any part of the water-soluble non-aromatic amine curing agent for the PVA is restricted by the limitation that that amine curing agent has a total of from 1 to about 12 carbons.

While the invention has been explained by detailed description of certain illustrative embodiments of it, it is understood that various changes and modifications can be made in them within the scope of the appended claims which are intended also to cover equivalents of those embodiments.

What is claimed is:

1. An aqueous acid, metal surface treating composition selected from

A. the concentrate containing by weight a total of from about 60 to about 85% of essential co-acting ingredients dissolved in from about 40 to about 15% of water, which essential co-acting ingredients a. consist essentially of chromium phosphate, chromic acid, a phosphate-ion-providing compound selected from phosphoric acid and its equivalent of an alkali metal or ammonium dihydrogen phosphate, the at least 99% hydrolyzed polyvinyl alcohol combined with chromium and phosphate, and a phosphate of a water-soluble, non-aromatic primary, secondary or tertiary amine having from one to about 12 carbon atoms and selected from alkyl amines, alkanol amines, morpholine and lower alkyl ring- or N-substituted morpholine, or mixtures of any of these amines, and b. are the products of admixing together in the water (i) as the most predominant constituent from about 9.6 to about 40 percent of phosphoric acid calculated as anhydrous $H_3PO_4$ or its phosphate ion equivalent of an alkali metal or ammonium dihydrogen phosphate, (ii) as the next predominant constituent from about 5% to about 30% of chromic acid as $CrO_3$, (iii) the aforesaid polyvinyl alcohol as the third essential constituent to the extent of from about 0.1 to about 10%, and (iv) as the fourth essential ingredient the aforesaid water-soluble, non-aromatic primary, secondary or tertiary amine and to the extent of from about 0.1 to about 1 percent of the concentrate; and heating their mixture to a temperature sufficient to induce the combining reaction of the chromic acid and phosphoric acid with the polyvinyl alcohol, and maintaining the temperature at from about 170° to about 210° F. until the bubbling caused by the exothermicity subsides; and B. a treating bath composed of from 0.5 percent of the aforesaid concentrate by volume and the rest being water.

2. An aqueous acid composition as claimed in claim 1 and wherein said phosphate-ion-providing compound is phosphoric acid.

3. A composition as claimed in claim 2, wherein said amine is an alkyl amine.

4. A composition as claimed in claim 3, wherein said polyvinyl alcohol is at least about 99.7% hydrolyzed.

5. A composition as claimed in claim 4, wherein said amine is dipropylamine.

6. A composition as claimed in claim 5, wherein there is included a wetting agent compatible with said co-acting ingredients.

7. A composition which is the concentrate of claim 6, and wherein the constituents in percent by weight are phosphoric acid (as 80% $H_3PO_4$) 30%, chromic acid as $CrO_3$ 23.4%, 99.7% hydrolyzed polyvinyl alcohol 1.5%, dipropylamine 0.3%, anionic wetting agent 0.3%, and water 44.5%.

8. A composition as claimed in claim 7, wherein the phosphoric acid is about 34% and the water is about 40.5%.

9. A metal surface treating bath composed by volume of from about 0.5 to about 20% of the concentrate of claim 6, and wherein there is included a wetting agent compatible with said co-acting ingredients.

10. A treating bath as claimed in claim 9, wherein the maximum of said concentrate is about 5%.

11. The method of producing a combined deposition and reaction protective coating on a zinc, galvanized steel, aluminum, copper, cadmium, titanium, steel, or tin surface, which method comprises applying to said surface an aqueous acid metal surface treating composition as claimed in claim 1 and for a time of from about a half second to about a minute sufficient for the protective coating reaction to take place substantially fully on it, and drying the thus coated surface.

12. The method as claimed in claim 11, wherein there is applied to said metal surface an aqueous acid treating bath containing by volume from 0.5 part to about 20 parts of the concentrate aqueous acid treating composition embraced in claim 11 to from 99.5 to about 80 parts of water, and said phosphate-ion-providing compound is phosphoric acid, said polyvinyl alcohol is at least 99.7% hydrolyzed, and said amine is a secondary alkyl amine; and there is included a wetting agent compatible with said co-acting ingredients.

13. The method as claimed in claim 12, wherein said metal surface is zinc and galvanized steel, and said metal surface treating bath contains by volume from 0.5 part to about 4 parts of said concentrate to from 99.5 to about 96 parts of water.

14. A metal selected from zinc, galvanized steel, aluminum, copper, cadmium, titanium, tin or steel with its surface directly coated with an integrally adhering dry water-insoluble deposition coating of a protective film of amine-cured at least 99% hydrolyzed polyvinyl alcohol combined with chromium and phosphate as described in part (b) of claim 1.

15. A coated metal as claimed in claim 14, wherein the substrate metal is zinc or galvanized steel, which coated metal is resistant to white rust developing on the zinc.

* * * * *